US009464485B2

(12) United States Patent
Hellvik

(10) Patent No.: US 9,464,485 B2
(45) Date of Patent: Oct. 11, 2016

(54) DRILL BIT WITH FIXED CUTTER ELEMENTS

(71) Applicant: SHELLCON AS, Lillehammer (NO)

(72) Inventor: Svein Hellvik, Lillehammer (NO)

(73) Assignee: SHELLCON AS, Lillehammer (NO)

( * ) Notice: Subject to any disclaimer, the term of this patent is extended or adjusted under 35 U.S.C. 154(b) by 0 days.

(21) Appl. No.: 14/769,219

(22) PCT Filed: Dec. 31, 2013

(86) PCT No.: PCT/NO2013/000059

§ 371 (c)(1),
(2) Date: Aug. 20, 2015

(87) PCT Pub. No.: WO2014/129905

PCT Pub. Date: Aug. 28, 2014

(65) Prior Publication Data

US 2016/0002980 A1 Jan. 7, 2016

(30) Foreign Application Priority Data

Feb. 20, 2013 (NO) ..... 20130280

(51) Int. Cl.

| | |
|---|---|
| ***E21B 10/55*** | (2006.01) |
| ***E21B 10/42*** | (2006.01) |
| ***E21B 17/07*** | (2006.01) |
| ***E21B 10/60*** | (2006.01) |

(52) U.S. Cl.

CPC ..... *E21B 10/42* (2013.01); *E21B 10/55* (2013.01); *E21B 10/602* (2013.01); *E21B 17/07* (2013.01)

(58) Field of Classification Search

CPC ..... E21B 10/42; E21B 10/602; E21B 17/07; E21B 10/55

See application file for complete search history.

(56) References Cited

U.S. PATENT DOCUMENTS

| | | | | |
|---|---|---|---|---|
| 2,567,084 | A | 9/1951 | Stokes | |
| 2,782,005 | A | 2/1957 | Appleton | |
| 3,135,103 | A * | 6/1964 | Black | E21B 17/073 464/20 |
| 5,671,816 | A | 9/1997 | Tibbitts | |
| 6,102,142 | A | 8/2000 | Besson et al. | |
| 6,945,338 | B1 * | 9/2005 | Defourny | E21B 10/00 175/101 |
| 8,261,632 | B2 | 9/2012 | Stevens | |
| 2007/0284150 | A1 | 12/2007 | Lin | |

FOREIGN PATENT DOCUMENTS

WO WO 2007/114749 A1 10/2007

* cited by examiner

*Primary Examiner* — Brad Harcourt

(74) *Attorney, Agent, or Firm* — Birch, Stewart, Kolasch & Birch, LLP

(57) ABSTRACT

A drill bit with fixed cutter elements with a hollow upper conical pin connector connectable to the lower module of a drill string, where the upper conical pin connector has a transition to an upper cylindrical module with a central channel for supplying bore fluid from the drill string, equipped with, a lower bore holding a cylindrical socket from the lower module, connecting the upper and lower modules of the drill bit, where the central channel continues down through the lower module and branches out into nozzle channels with nozzles ending in the recesses in between the wings with fixed PDC-cutters, wherein elastic shock-absorber elements are arranged in recesses in the cylindrical wall of the bore, in the upper cylindrical module, and the elastic shock-absorbers are assembled on the bolts extending into the cylindrical socket of the lower module.

4 Claims, 3 Drawing Sheets

Fig. 1
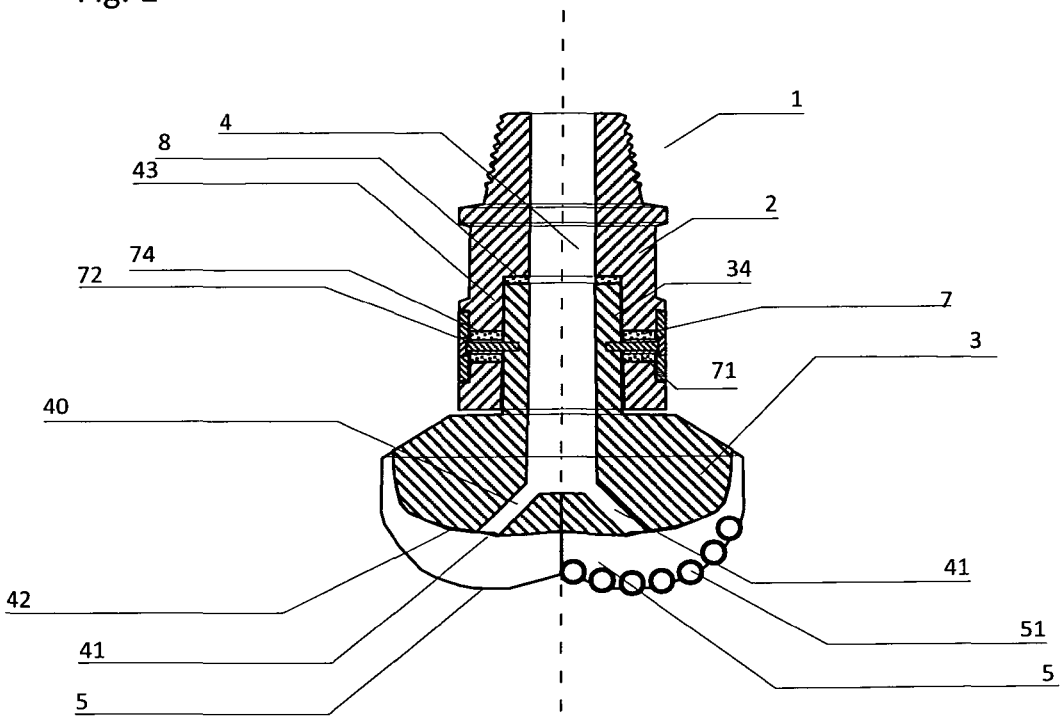
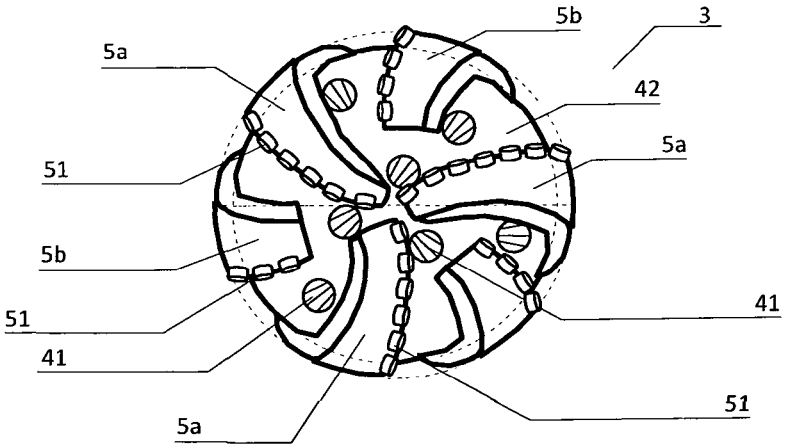
Fig. 2

DRILL BIT WITH FIXED CUTTER ELEMENTS

The present invention concerns a drill bit. More specifically the invention concerns a drill bit with so-called "fixed cutter", i.e. fixed polycrystalline-diamond cutters, PDC, attached to a fixed drill bit.

DESCRIPTION OF BACKGROUND ART

The drill bit of the present invention will be employed in drilling in various types of rock, such as variations from limestone to clay shale. Vibrations in the drill bit occur due to variations in the friction between the drill bit and the bore hole wall/bottom, and are modulated by the mass of the drill bit, weight on bit, torsion on bit, as well as by interaction with the drill string. Such vibrations in the shape of rapidly shifting torsion momentum on the drill bit will propagate over to the drill string, and are undesired.

A so-called PDC-drill bit comprises a forged steel crown with an upper hollow conical pin connector connectable to the lower module of a drill string, The drill string is a tool, more or less cylindrical, hollow with a central channel for bore fluid to nozzles in the crown, where the crown normally comprises wings with cylindrical-shaped PDC-cutters fixed on top of the wings. The PDC-cutters lean forward in order for parts of the front surface to scratch frontally against the bottom of the bore hole, cutting out a similar shallow circular recess. The bore fluid nozzles end in the recesses between the wings, and wash away the residue and cool down the PDC-cutters. The PDC-cutters can be solded or welded into cylindrical recesses in the drill bit. The drill bit can be equipped with a string fixed into a cylindrical breaker slot with a hollow upper pin connector.

The crown itself, underneath the cylindrical, hollow string, can be a so-called matrix bit made out of a pressed, sintered ceramical/metallic powder material, where the PDC-cutters are fixed to the pressed matrix. Then will the drill bit be equipped with a string fixed into a cylindrical breaker slot with a hollow upper pin connector.

U.S. Pat. No. 8,261,632B2 describes methods of forming bit-bodies for earth-boring bits including assembling and sintering of green components that have been infiltrated, brown components that have been infiltrated, or fully sintered components that have been infiltrated.

Other methods include isostatically pressing a powder to form a green body substantially composed of a particle-matrix composite material, and sintering or hot isostatic pressing the green body or the brown body to provide a bit body having a desired final density.

Methods of forming earth-boring bits include providing a bit body substantially formed of a particle-matrix composite material and attaching a shank to the body.

The body is provided by pressing a powder to form a green body and sintering the green body.

U.S. Pat. No. 6,102,142A describes a drilling tool including a drilling head equipped with cutting edges and fitted with several shock-absorption elements, of which at least one part is made of an elastomer material. Each shock-absorption element having a block incorporating one portion inserted inside a receptor housing formed on the tool surface, and a portion which projects outward beyond the receptor housing.

BRIEF SUMMARY

The invention is a drill bit with fixed cutter elements with a hollow upper conical pin connector (1) connectable to the lower module of a drill string, where the upper conical pin connector (1) has a transition to an upper cylindrical module (2) with a central channel (4) for supplying bore fluid from the drill string, equipped with, a lower bore (43) holding a cylindrical socket (34) from the lower module (3), connecting the upper and lower modules (2,3) of the drill bit, where the central channel (4) continues down through the lower module (3) and branches out into nozzle channels (40) with nozzles (41) ending in the recesses (42) in between the wings (5) with fixed PDC-cutters (51), characterized by elastic shock-absorber elements (7) arranged in recesses (73) in the cylindrical wall of the bore (43), in the upper cylindrical module (2), where the elastic shock-absorbers (7) are assembled on the bolts (72) extending into the cylindrical socket (34) of the lower module (3).

DRAWINGS

FIG. 1 is a cross-section view of the drill bit according to the present invention.

FIG. 2 is a bottom view of the drill bit according to the present invention.

DETAILED DESCRIPTION OF THE INVENTION

Figure 3:
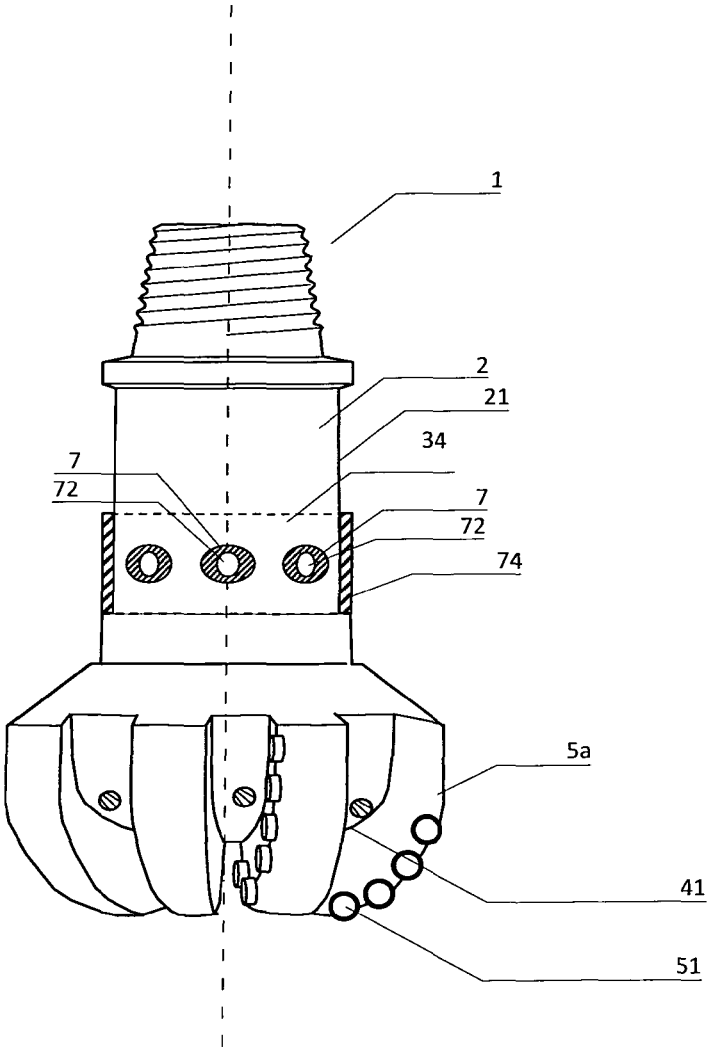
FIG. 3 is elevation view of the drill bit as shown in FIG. 1.
Figure 4:
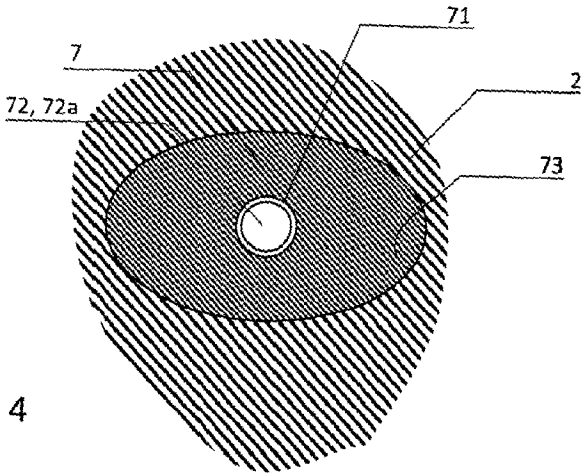
FIG. 4 illustrates an enlarged elevation view of the shock-absorber element from the side, as an elliptical cut.
Figure 5:
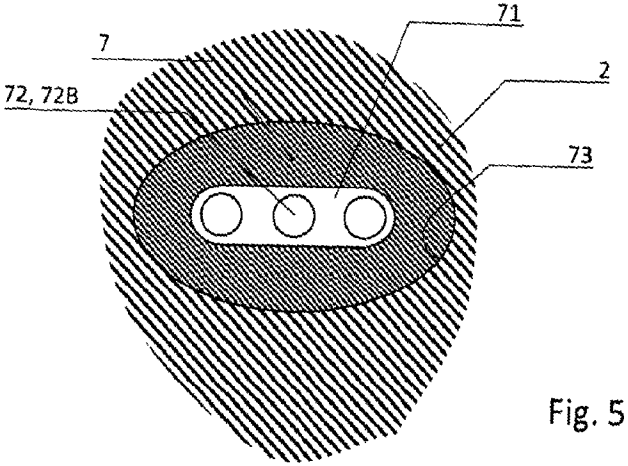
FIG. 5 illustrates an elliptic disc shaped body in an elliptical elastic element according to the invention.
Figure 6:
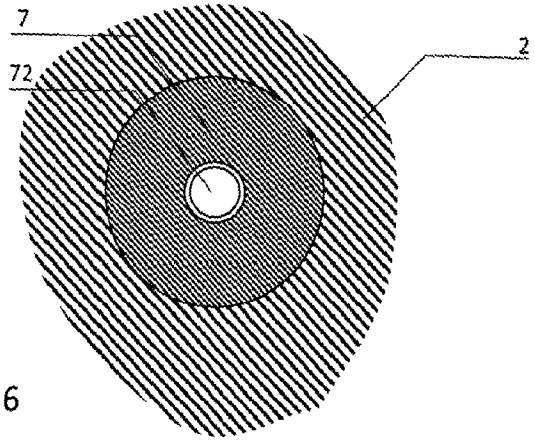
FIG. 6 illustrates a circular cylindrical elastic element according to the invention.

FIG. 1 is a cross-section view of the drill bit according to the present invention. The drill bit has a hollow upper conical pin connector (1) connectable to the lower module of a drill string, where the upper conical pin connector (1) has a transition to a hollow upper cylindrical module (2) equipped with a bore (43) with a wider diameter than the central channel (4), and where a hollow cylindrical socket (34) from the lower module (3) mounted on the bore (43), connecting the upper and lower modules (2,3) of the drill bit. The central channel (4) continues down through the lower module (3) and branches out into nozzle channels (40) with nozzles (41) ending in the recesses (42) in between the wings (5) with fixed PDC-cutters (51).

FIG. 2 is a bottom view of the drill bit according to the present invention. This figure shows two types of wings (5) with fixed PDC-cutters (51): Three wings (5*a*) stretches from the periphery of the drill bit and almost in to the center of the drill bit. Three wings (5*b*), which are shorter than the first three wings (5*a*) and stretches from the periphery of the drill bit and half way to the center of the drill bit. The recess (42) stretches between the two types of wings (5*a*, 5*b*) and past the inner point of the shorter wing (5*b*).

FIG. 1 and FIG. 3 shows a so-called breaker slot (21) arranged to hold the drill bit when the lower module of a drill string is connected to or disconnected to a hollow upper conical part (1).

The novelty of the invention is illustrated in FIG. 1 and in FIG. 3 where a protective sleeve (74) is shown, partly transparent. Elastic shock-absorber elements (7) are arranged in recesses (73) in the cylindrical wall of the bore (43), in the upper cylindrical module (2), where the elastic shock-absorbers (7) are assembled on the bolts (72) extending into the cylindrical socket (34) of the lower module (3).

Alternatively the assembly of the elastic shock-absorber elements (7) can be turned over and arranged in recesses (73) into the cylindrical socket (34) of the lower module (3), where the elastic shock-absorbers (7) are assembled on the bolts (72) extending into the cylindrical wall of the bore (43) of the cylindrical upper module (2).

There can be three, four, six, or more elastic shock-absorber elements (7) arranged peripheral in the connector between the socket (34) and the bore (43), depending on the diameter of the drill bit. The diameter can be from 73 mm, up to 445 mm or bigger. In case a bolt (72) is being used, a metal guide (71) can be used between the bolt and the elastic shock-absorber element (7).

The shock-absorber element (7) can be made of synthetic rubber or something similar, or elastic steel. Small hydraulic pistons and cylinders can also be arranged with a fluid or a flow of fluid as a shock-absorber element.

In order to avoid that the shock-absorber element (7) are exposed to the well fluid there can be arranged with a protective sleeve (74) over the outer ends of the shock-absorber elements (7) in one embodiment of the invention.

In one embodiment of the drill bit with fixed cutters according to the invention there can be arranged with a seal (8), as an axial curbing between the top of the socket (34) and the bottom of the bore (43).

In simpler terms the invention can be explained as a drill bit with fixed cutter elements with a hollow upper conical pin connector (1) connectable to the lower module of a drill string, where the upper conical pin connector (1) has a transition to an upper cylindrical module (2) with a central channel (4) for supplying bore fluid from the drill string, equipped with, a lower bore (43) holding a cylindrical socket (34) from the lower module (3), connecting the upper and lower modules (2,3) of the drill bit, where the central channel (4) continues down through the lower module (3) and branches out into nozzle channels (40) with nozzles (41) ending in the recesses (42) in between the wings (5) with fixed PDC-cutters (51), with elastic shock-absorber elements (7) arranged in recesses (73) in the cylindrical wall of the bore (43), in the upper cylindrical module (2), where the elastic shock-absorbers (7) are assembled on the bolts (72) extending into the cylindrical socket (34) of the lower module (3), alternatively turned over as being described above.

The invention claimed is:

1. A drill bit with fixed cutter elements, comprising:

a hollow upper conical pin connector connectable to a lower module of a drill string;

the lower module of the drill string, including wings with fixed polycrystalline-diamond cutters;

an upper cylindrical module with a central channel for supplying bore fluid from the drill string, the upper conical pin connector having a transition to the upper cylindrical module; and a lower axial bore equipped in the upper cylindrical module, the lower axial bore holding a cylindrical socket from the lower module, and connecting the upper and lower modules of the drill bit, wherein the central channel continues down through the lower module and branches out into nozzle channels with nozzles ending in recesses in between the wings of the lower module, wherein elastic shock-absorber elements are arranged in recesses in a cylindrical wall of the lower axial bore, in the upper cylindrical module, and the elastic shock-absorbers are assembled on bolts extending into the cylindrical socket of the lower module, and wherein the elastic shock-absorber elements are elliptic, with largest axes thereof arranged at right angles to an axis of the drill bit.

2. The drill bit with fixed cutter elements of claim 1, wherein the elastic shock-absorber elements are cylindrical.

3. The drill bit with fixed cutter elements of claim 1, wherein the bolts of the elastic shock-absorber elements are disc shaped and rounded, and stretch at the same level as the largest axes of the elliptical elastic shock-absorber elements.

4. The drill bit with fixed cutter elements of claim 1, wherein the drill bit is further arranged with a seal, as an axial curbing between a top of the cylindrical socket and a bottom of the lower axial bore.

* * * * *